US008419305B2

(12) United States Patent
Takami

(10) Patent No.: US 8,419,305 B2
(45) Date of Patent: Apr. 16, 2013

(54) CUTTING MECHANISM FOR PRINTING APPARATUS, AND PRINTING APPARATUS INCLUDING THE SAME

(75) Inventor: Hiroshi Takami, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 815 days.

(21) Appl. No.: 12/584,901

(22) Filed: Sep. 15, 2009

(65) Prior Publication Data

US 2010/0086340 A1 Apr. 8, 2010

(30) Foreign Application Priority Data

Oct. 8, 2008 (JP) ..... 2008-262235

(51) Int. Cl.
*B41J 11/70* (2006.01)

(52) U.S. Cl.
USPC ..... 400/621; 83/694

(58) Field of Classification Search ..... 400/621; 83/679, 694, 695; *B26D 7/18, 1/08, 1/09; B41J 11/70*
See application file for complete search history.

(56) References Cited

U.S. PATENT DOCUMENTS 5,783,032 A * 7/1998 O'Callaghan et al. ..... 156/556
6,491,460 B1 12/2002 Sodeyama et al.

FOREIGN PATENT DOCUMENTS

| | | | |
|---|---|---|---|
| JP | 9-285221 A | | 11/1997 |
| JP | 11-892 | | 1/1999 |
| JP | 2003-211756 | * | 1/2002 |
| JP | 3833784 | | 7/2006 |
| JP | 2006-305662 | * | 9/2006 |
| JP | 2007-190650 | | 8/2007 |
| JP | 2007-229911 A | | 9/2007 |

OTHER PUBLICATIONS

Extended European Search Report of EP 09170660.6 dated Nov. 7, 2012.

* cited by examiner

*Primary Examiner* — Judy Nguyen
*Assistant Examiner* — Marissa Ferguson Samreth
(74) *Attorney, Agent, or Firm* — McCarter & English, LLP

(57) ABSTRACT

A cutting mechanism for a printing apparatus that cuts a printing medium and includes a fixed blade having first through holes and a movable blade having second through holes and slidingly movable with respect to the fixed blade, wherein each of first openings of the first through holes on a first sliding face is at least partly included in a first overlapping portion, each of second openings of the second through holes on a second sliding face is at least partly included in a second overlapping portion, and the first openings and the second openings are located at positions such that the first openings and the second openings do not overlap completely with each other in a direction orthogonal to a movement direction of the movable blade with respect to the fixed blade.

10 Claims, 19 Drawing Sheets

CUTTING MECHANISM FOR PRINTING APPARATUS, AND PRINTING APPARATUS INCLUDING THE SAME

CROSS-REFERENCE TO RELATED APPLICATION

This application claims priority to Japanese Patent Application No. 2008-262235, filed Oct. 8, 2008, the disclosure of which is hereby incorporated by reference herein in its entirety.

BACKGROUND

The disclosure relates to a cutting mechanism for a printing apparatus that cuts a printing medium including an adhesive layer, and a printing apparatus that includes the cutting mechanism.

Various types of tape printing apparatuses are known that detachably accommodate a roll sheet holder in a case. The roll sheet holder is wound with a long roll sheet. In a tape printing apparatus of this type, the roll sheet wound on the roll sheet holder is drawn and fed by the drive of a platen roller, and characters, figures, and the like are printed on the roll sheet by a thermal head that is pressed against the platen roller. The printed roll sheet is cut to a desired length by a cutting mechanism and is discharged to the outside through a sheet discharge port.

As a cutting mechanism, a so-called guillotine cutter is known. A guillotine cutter includes a fixed blade that is provided throughout the entire width on one face side of a roll sheet, and a movable blade that moves in the thickness direction of the roll sheet while sliding with respect to the fixed blade. The roll sheet to be cut by the guillotine cutter has, for example, a separable paper separably bonded on the back face of the sheet with an adhesive interposed therebetween. When such a roll sheet is cut by a guillotine cutter, the adhesive may adhere to the movable blade. In such a case, a problem may arise that the cut sheet is pulled by the adhesive that has adhered to the movable blade and, during the cutting of the subsequent sheet, a portion of the previously cut sheet is cut again.

Therefore, for example, a cutter unit is known that includes a fixed blade and a movable blade each having a groove for receiving an adhesive. Each groove is formed substantially parallel to the cutting edge and throughout the width direction. According to the cutter unit, when the fixed blade and the movable blade slide with respect to each other, the adhesive that has adhered to the fixed blade and the movable blade is dropped into the grooves formed in the fixed blade and the movable blade. Thus, poor cutting due to the adhesion of the adhesive to the blades may be prevented.

SUMMARY

In the above-described conventional cutter unit, when the grooves become full of the adhesive, no more adhesive can be dropped into the grooves during the subsequent cutting. In such a case, cutting ability may be deteriorated because the adhesive that has adhered to the blades is not removed any more. Further, if the depths of the grooves formed in the blades are increased in order to increase the amount of the adhesive that can be dropped into the grooves, the strength of the blades may decrease.

The present disclosure has an object to provide a cutting mechanism for a printing apparatus in which an adhesive that has adhered to a blade face of a fixed blade and a blade face of a movable blade can be removed while maintaining a strength of the blades, and a printing apparatus including the cutting mechanism.

Exemplary embodiments provide a cutting mechanism for a printing apparatus that cuts a printing medium. The cutting mechanism includes a fixed blade having a plurality of first through holes and a movable blade having a plurality of second through holes and slidingly movable with respect to the fixed blade. Each of a plurality of first openings is at least partly included in a first overlapping portion, and each of a plurality of second openings is at least partly included in a second overlapping portion. The first openings are openings of the first through holes on a first sliding face, which is one face of the fixed blade over which the fixed blade slides with respect to the movable blade. The first overlapping portion is a portion of the fixed blade at which the fixed blade slides with respect to and overlaps with the movable blade. The second openings are openings of the second through holes on a second sliding face, which is one face of the movable blade over which the movable blade slides with respect to the fixed blade. The second overlapping portion is a portion of the movable blade at which the movable blade slides with respect to and overlaps with the fixed blade. Further, the first openings and the second openings are located at positions such that the first openings and the second openings do not overlap completely with each other in a width direction, which is a direction orthogonal to a movement direction of the movable blade with respect to the fixed blade.

Exemplary embodiments also provide a printing apparatus that includes a cutting mechanism that cuts a printing medium. The cutting mechanism includes a fixed blade having a plurality of first through holes and a movable blade having a plurality of second through holes and slidingly movable with respect to the fixed blade. Each of a plurality of first openings is at least partly included in a first overlapping portion, and each of a plurality of second openings is at least partly included in a second overlapping portion. The first openings are openings of the first through holes on a first sliding face, which is one face of the fixed blade over which the fixed blade slides with respect to the movable blade. The first overlapping portion is a portion of the fixed blade at which the fixed blade slides with respect to and overlaps with the movable blade. The second openings are openings of the second through holes on a second sliding face, which is one face of the movable blade over which the movable blade slides with respect to the fixed blade. The second overlapping portion is a portion of the movable blade at which the movable blade slides with respect to and overlaps with the fixed blade. Further, the first openings and the second openings are located at positions such that the first openings and the second openings do not overlap completely with each other in a width direction, which is a direction orthogonal to a movement direction of the movable blade with respect to the fixed blade.

BRIEF DESCRIPTION OF THE DRAWINGS

Exemplary embodiments of the present disclosure will be described below in detail with reference to the accompanying drawings in which.

DETAILED DESCRIPTION

Exemplary embodiments of a cutting mechanism, and a printing apparatus including the cutting mechanism, of the present disclosure will be described below with reference to the drawings. First, a tape printing apparatus 1 and a cutter unit 8 of an exemplary embodiment will be described. The tape printing apparatus 1 of the embodiment accommodates a roll sheet 30, which is a rolled printing medium. The tape printing apparatus 1 prints characters, figures, or the like on the roll sheet 30, cut the roll sheet 30 to a desired length, and discharge the cut roll sheet 30. The cutter unit 8 is mounted on the tape printing apparatus 1 to cut the roll sheet 30.

Figure 1:
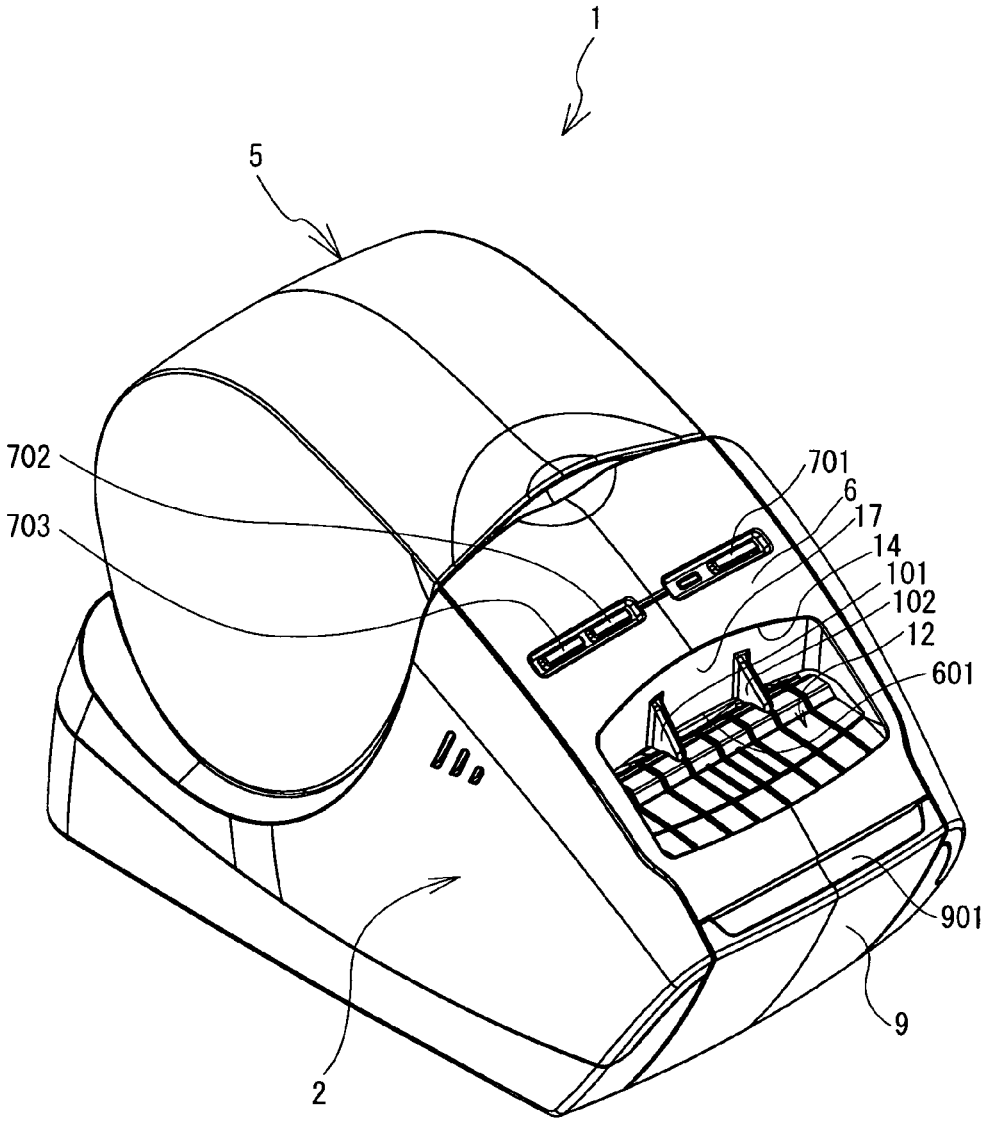
FIG. 1 is a perspective view of a tape printing apparatus, as seen from the left front side.
Figure 2:
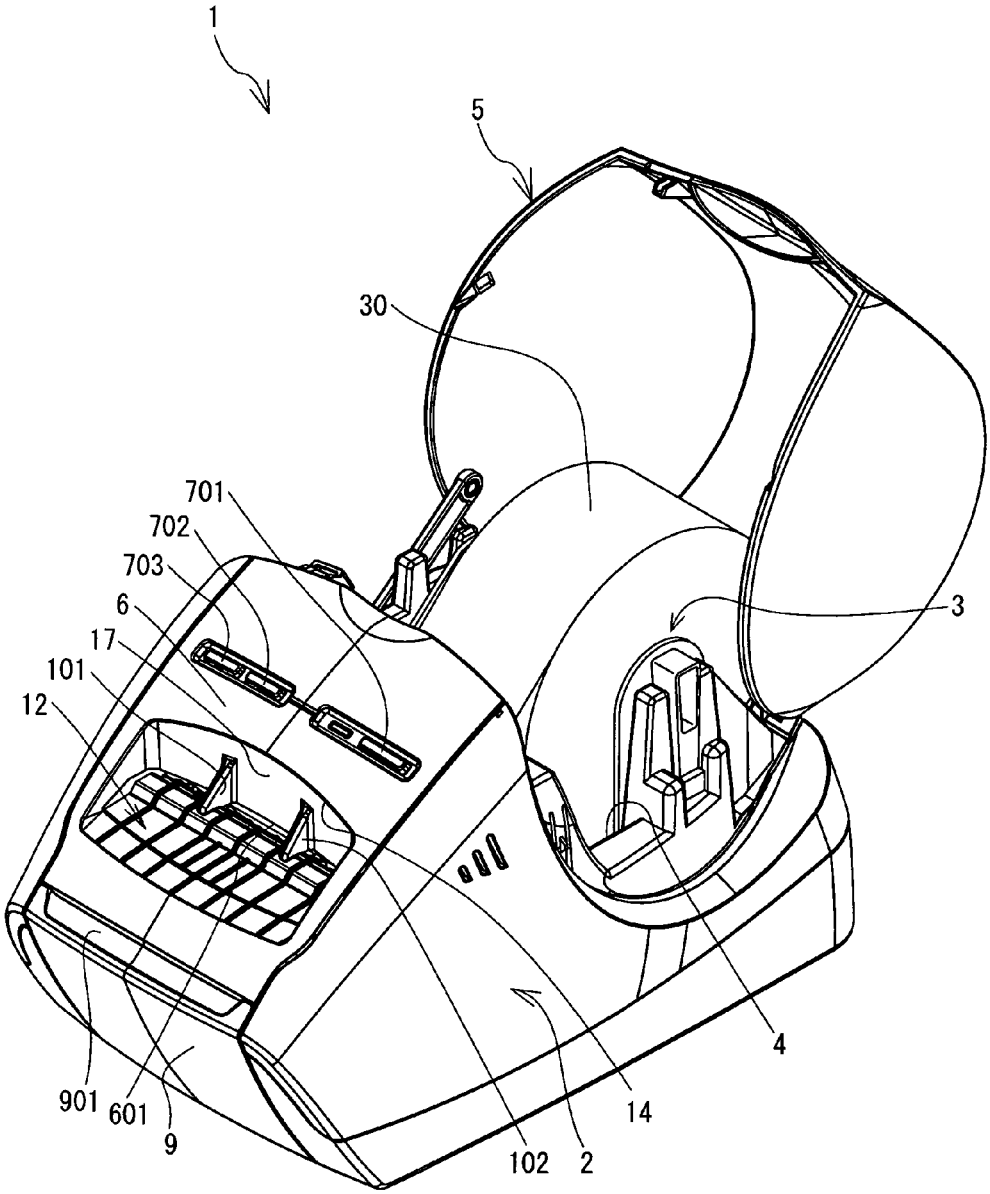
FIG. 2 is a perspective view of the tape printing apparatus in which a roll sheet holder 3 has been loaded thereon, as seen from the right front side.

First, a schematic configuration of the tape printing apparatus 1 will be described with reference to FIGS. 1 and 2. In FIG. 1, the upper right side is regarded as the right side of the tape printing apparatus 1, the lower left side is regarded as the left side of the tape printing apparatus 1, the lower right side is regarded as the front side of the tape printing apparatus 1, and the upper left side is regarded as the rear side of the tape printing apparatus 1.

As shown in FIG. 1, the tape printing apparatus 1 includes a main body case 2 made of resin. As shown in FIG. 2, a roll sheet holder-accommodating portion (hereinafter referred to as a "holder-accommodating portion") 4 is provided inside a rear portion of the main body case 2. The holder-accommodating portion 4 serves as a space in which a roll sheet holder 3 is loaded. A roll sheet having a predetermined width is wound around the roll sheet holder 3. A top cover 5 made of a transparent resin and having a substantially semi-circular shape in a side view is openably/closably mounted on a top end edge portion on the rear side of the main body case 2 so as to cover the holder-accommodating portion 4.

Further, the main body case 2 has a resin-made front cover 6 for covering the front side of the main body case 2 on the front side of the top cover 5. An opening 14 having a substantially rectangular shape in a front view is provided in a central portion of the front cover 6. A sheet discharge port 601 for discharging a printed roll sheet 30 to the outside is provided substantially horizontally on the deep side in a central portion of the opening 14. An inner wall 17 is extended downward from the top edge of the opening 14 toward the sheet discharge port 601. A pair of retaining ribs 101 and 102 are projected forward on a front face of the inner wall 17. The retaining ribs 101 and 102 are in a form of plates each having a triangular shape in a side view. The retaining ribs 101 and 102 are designed to retain the roll sheet 30 discharged through the sheet discharge port 601 from above. A stage 12 having a substantially rectangular shape in a plan view is extended forward in front of the sheet discharge port 601. The stage 12 is formed as a resin plate having a plurality of ribs on a top face. The roll sheet 30 that has been discharged through the sheet discharge port 601 is pushed out onto the stage 12 while being retained by the retaining ribs 101 and 102 from above and maintaining its substantially horizontal state.

A power button 701, a cut button 702, and a feed button 703 are arranged substantially horizontally above the opening 14. When the cut button 702 is pressed, the cutter unit 8 (see FIG. 3), which will be described later, provided inside the sheet discharge port 601 is driven to cut the roll sheet 30. When the feed button 703 is pressed, the roll sheet 30 is discharged in a feeding direction.

A resin-made tray member 9 having a rectangular shape in a front view is openably/closably provided on the lower side of the front face of the main body case 2, in front of the front cover 6. The bottom portion of the tray member 9 is pivotally supported on the bottom portion of the front face of the main body case 2. A concave portion 901 is formed at the top end edge of the tray member 9. A user may open the tray member 9 by hooking a finger on the concave portion 901 and pivotally moving the tray member 9 forward. The roll sheet 30 that has been discharged through the sheet discharge port 601 may be accumulated on the opened tray member 9.

Figure 3:
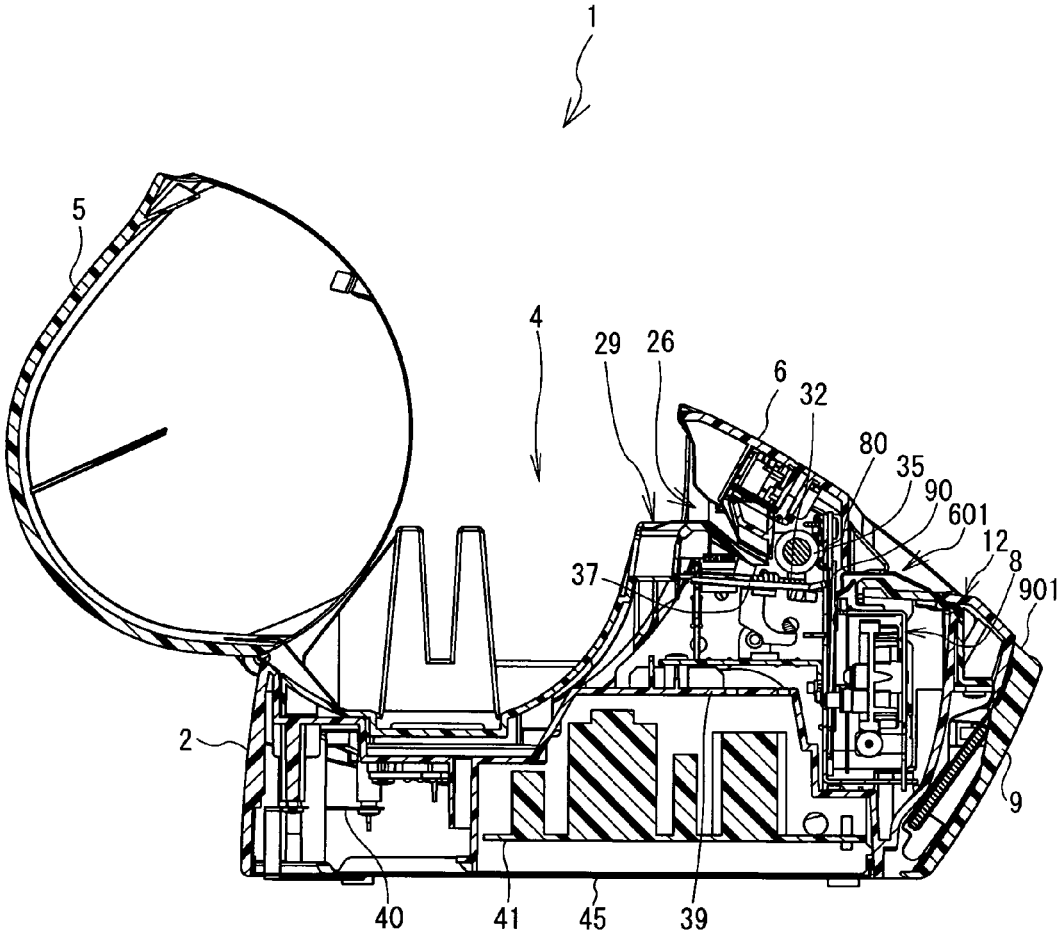
FIG. 3 is a vertical sectional view of the tape printing apparatus.
Figure 4:
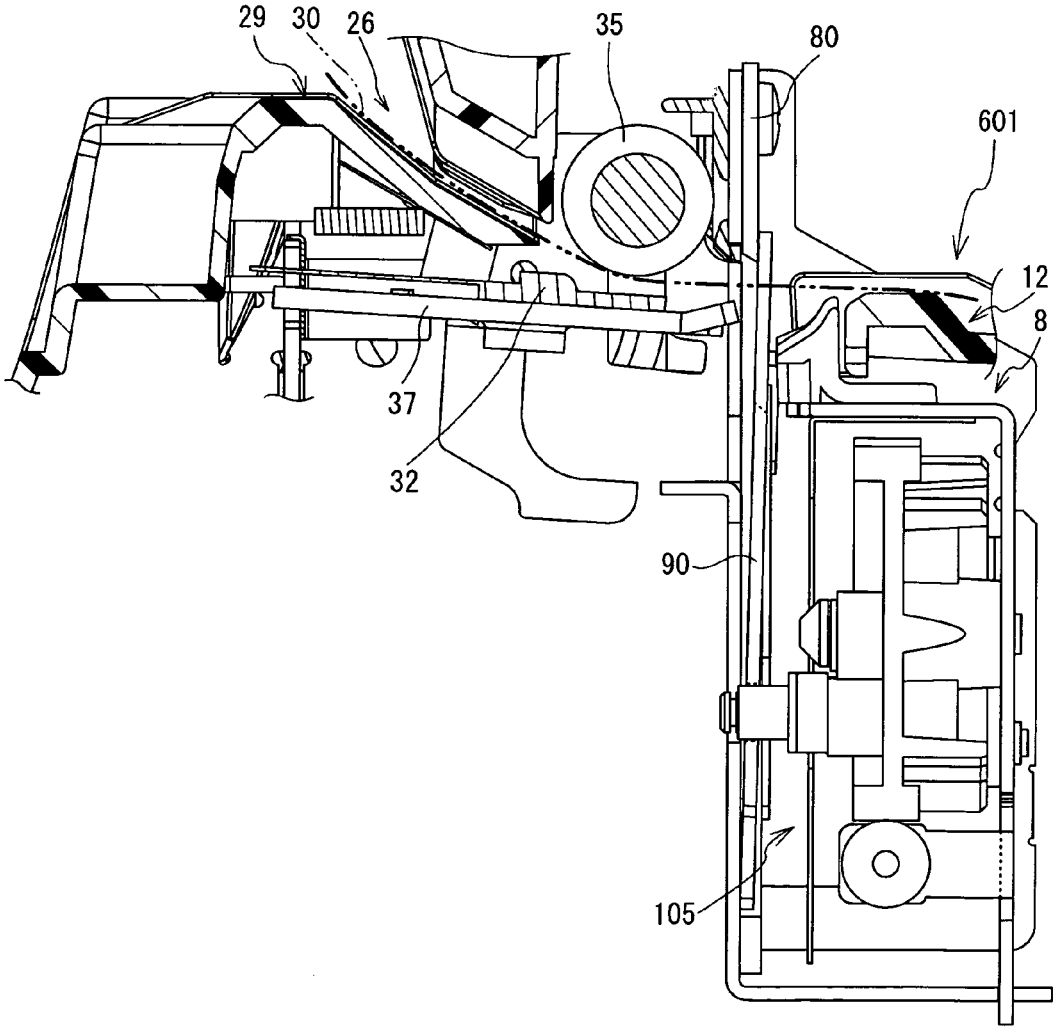
FIG. 4 is an enlarged view of a peripheral portion of a thermal head shown in FIG. 3.

Next, an internal configuration of the main body case 2 will be described with reference to FIGS. 3 and 4. As shown in FIG. 3, the holder-accommodating portion 4 has a curved concave shape in a side view. A loading portion 29 is extended forward substantially horizontally from the top end edge on the front side of the holder-accommodating portion 4. An insertion port 26, into which the roll sheet 30 is inserted, is provided above the front end of the loading portion 29. As shown in FIG. 4, a sheet feeding path extends from the insertion port 26 to the sheet discharge port 601. The roll sheet 30 is fed along the sheet feeding path. A platen roller 35 that feeds the roll sheet 30 is rotatably provided above the sheet feeding path. A thermal head 32 is supported below the sheet feeding path, at a position opposing the platen roller 35, such that the thermal head 32 may come into contact with or separate from the platen roller 35. Specifically, a heat sink 37 made of metal is fixed on the bottom face of the thermal head 32, and the heat sink 37 is swingably supported. In such a manner, the thermal head 32 may come into contact with or separate from the platen roller 35.

The cutter unit 8 is provided on the downstream side of the thermal head 32 in the feeding direction of the roll sheet 30. The cutter unit 8 includes a fixed blade 80 disposed above the sheet feeding path, a movable blade 90 disposed below the sheet feeding path, and a drive mechanism 105 configured to move the movable blade 90. If the cut button 702 (see FIG. 1) is depressed, the movable blade 90 is reciprocated vertically by the drive of a drive motor 19 (see FIG. 6) of the drive mechanism 105. The roll sheet 30 is cut between the fixed blade 80 and the movable blade 90. The cut roll sheet 30 is discharged through the sheet discharge port 601. A detailed structure of the cutter unit 8 will be described later.

As shown in FIG. 3, a control board 40 is provided below the holder-accommodating portion 4, with a partition wall 39 therebetween. The control board 40 has a control circuit formed thereon that drives and controls respective mechanisms such as the thermal head 32 in accordance with instructions from an external personal computer or the like. Further, a power supply board 41 is provided below a printing mechanism, with the partition wall 39 therebetween. The printing mechanism includes the thermal head 32, the platen roller 35, and the like. The power supply board 41 has a power supply circuit formed thereon. The thermal head 32 is connected to a connector (not shown) provided on the bottom face of the control board 40 with a flexible flat cable (FFC) (not shown). The control board 40 and the power supply board 41 are covered with a bottom face cover 45, which is made of a thin steel plate screwed onto the bottom portion of the main body case 2.

Figure 5:
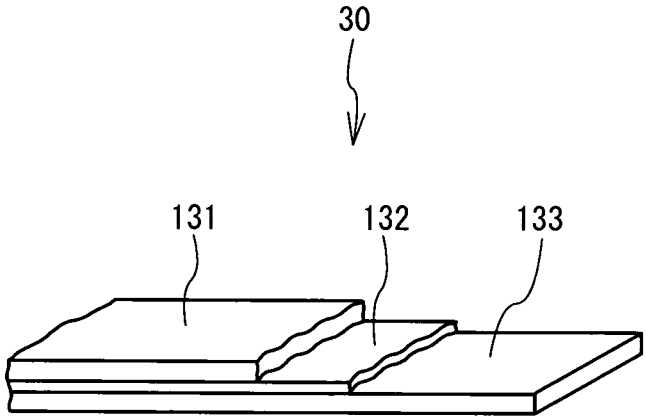
FIG. 5 is a partly cutaway perspective view of a roll sheet.

The roll sheet 30 will be described with reference to FIG. 5. The roll sheet 30 is, for example, a roll sheet of an undefined length that is wound around and held by the roll sheet holder 3 for use. The roll sheet 30 includes, for example, three layers. The layers may include a heat-sensitive sheet 131, an adhesive layer 132, and a separable sheet 133. The adhesive layer 132 is applied and formed on a face of the heat-sensitive sheet 131. The separable sheet 133 is separably bonded on the face of the heat-sensitive sheet 131 with the adhesive layer 132 interposed therebetween. The roll sheet 30 may be a die-cut label sheet that includes separably bonded die-cut labels on the separable sheet 133.

Figure 6:
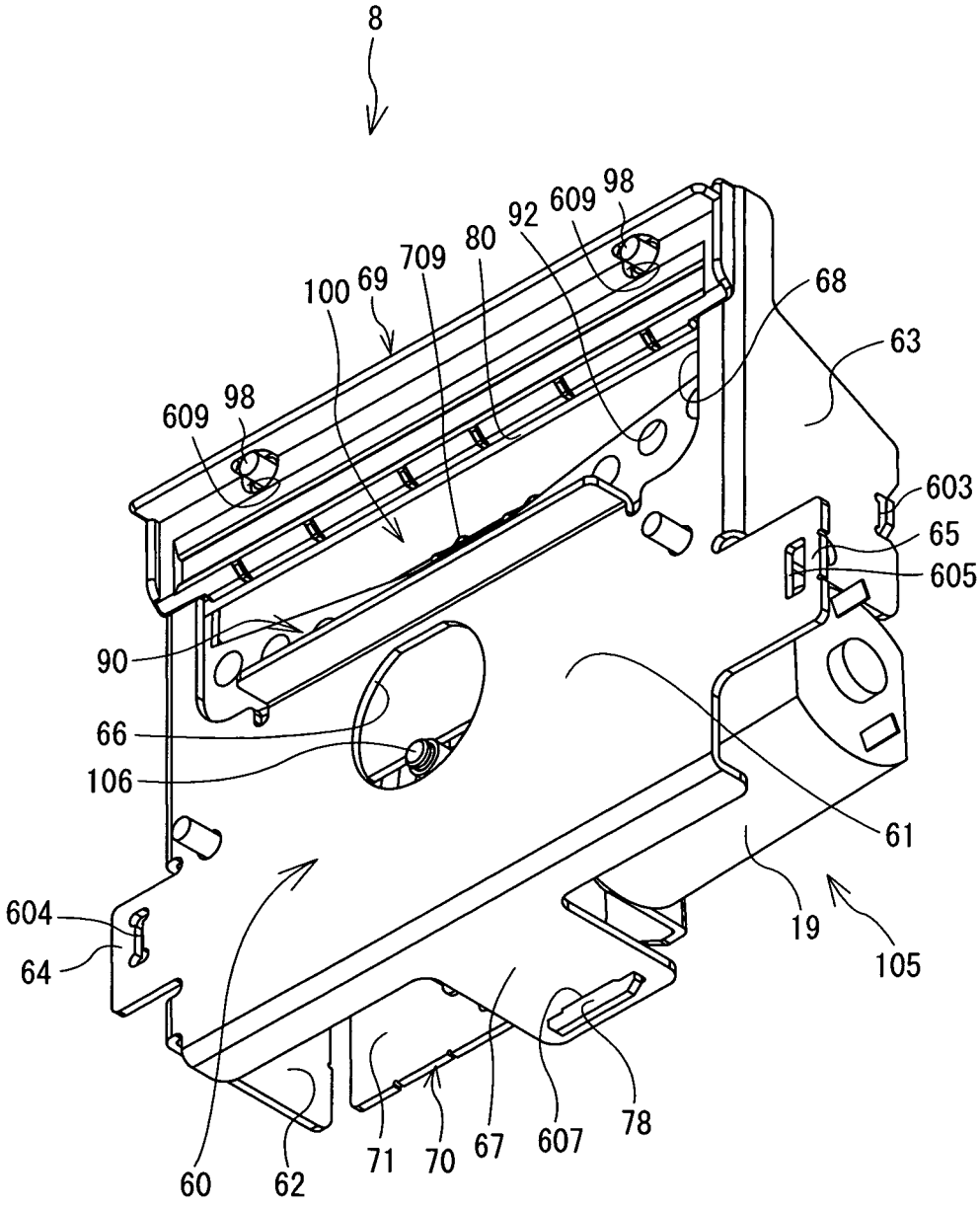
FIG. 6 is a perspective view of a cutter unit, as seen from the back side.
Figure 7:
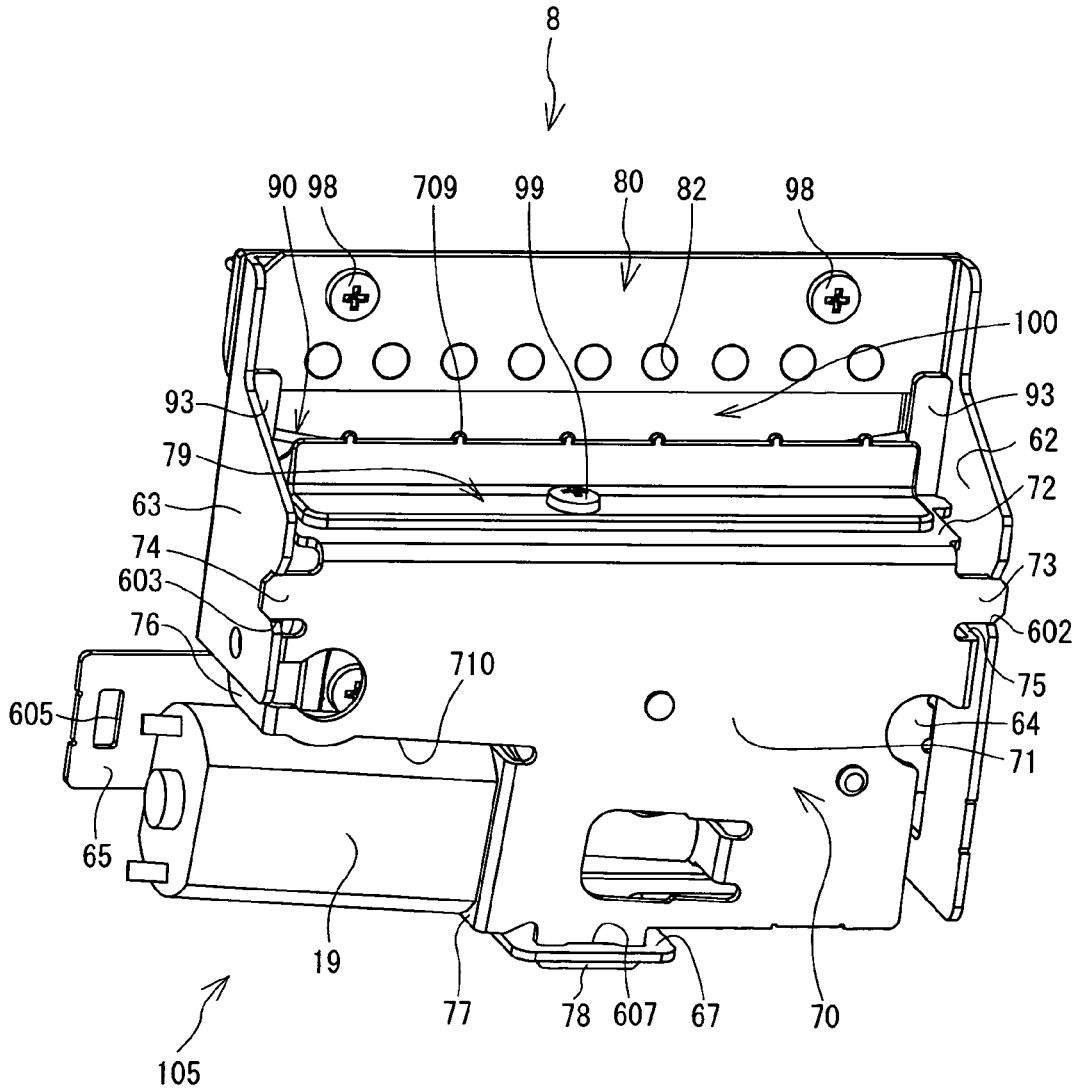
FIG. 7 is a perspective view of the cutter unit, as seen from the front side.
Figure 8:
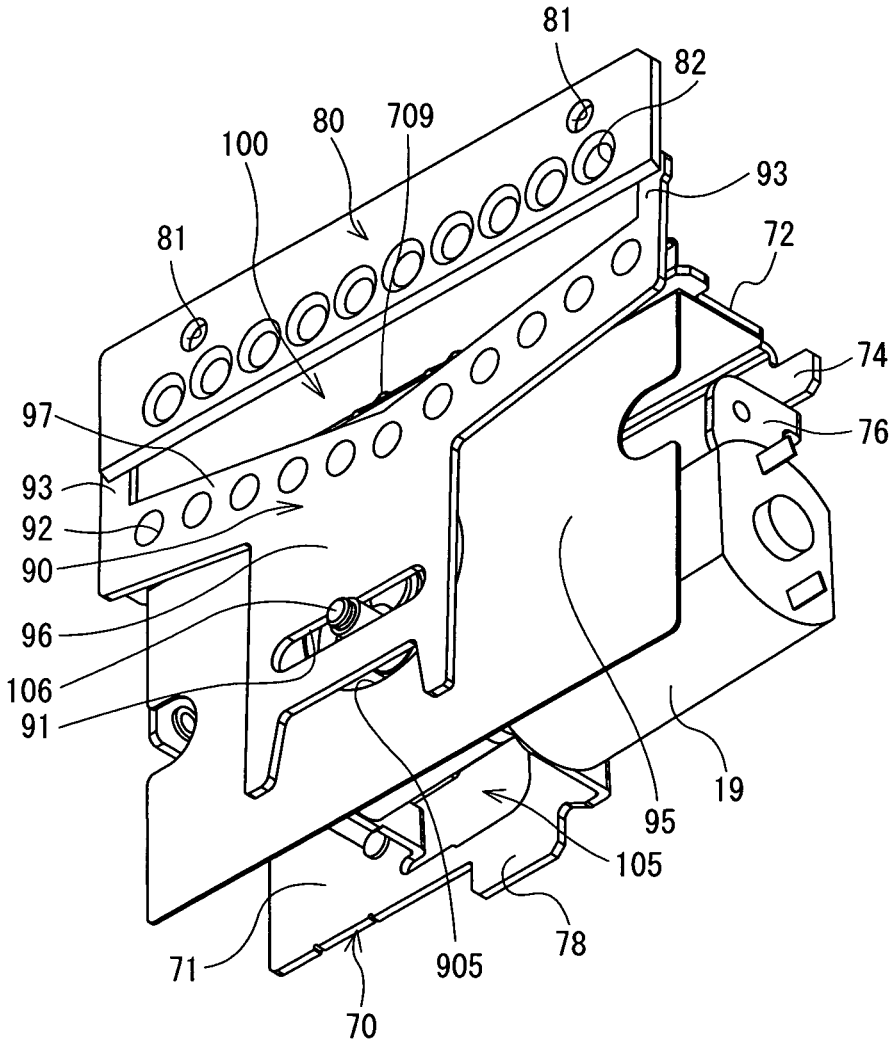
FIG. 8 is a perspective view of a cutter unit intermediate body, which is the cutter unit shown in FIG. 6 from which a main body frame has been removed.

Next, the structure of the cutter unit 8 will be described with reference to FIGS. 6 to 8. As shown in FIGS. 6 to 8, the cutter unit 8 includes a main body frame 60, a protective frame 70, the fixed blade 80, the movable blade 90, the drive mechanism 105, and a protective film 95. The main body frame 60 has an L-shaped longitudinal section. The protective frame 70 has an inverted L-shaped longitudinal section, and is assembled onto the main body frame 60. The fixed blade 80 is fixed at a top portion of the inner face of the main body frame 60. The movable blade 90 is supported from below such that the movable blade 90 can be raised and lowered from the lower side with respect to the fixed blade 80 and is moved by the drive mechanism 105. The protective film 95 is provided for protecting the drive mechanism 105.

First, the main body frame 60 will be described. As shown in FIG. 6, the main body frame 60 made of metal includes a main body portion 61 having a rectangular shape in a front view. A right side wall piece 62 and a left side wall piece 63 are extended forward at a right angle from a top portion of the right and left ends of the main body portion 61, respectively. Locking concave portions 602 and 603 are provided at leading end portions of the right side wall piece 62 and the left side wall piece 63, respectively. Mounting pieces 64 and 65 are extended outward substantially horizontally from a bottom portion of the right and left ends of the main body portion 61, respectively. The mounting pieces 64 and 65 have mounting holes 604 and 605, respectively. The mounting pieces 64 and 65 are used to fix the cutter unit 8 inside the main body case 2 of the tape printing apparatus 1. A mounting piece 67 having a rectangular shape in a plan view is extended forward at a right angle from a central portion of the bottom end of the main body portion 61. The mounting piece 67 has a mounting hole 607. An insertion hole 68 having a substantially laterally elongated rectangular shape in a front view is provided on the upper side of the main body portion 61. The roll sheet 30 is inserted through the insertion hole 68 so as to be cut by the fixed blade 80 and the movable blade 90.

A pair of fixing holes (not shown) for fixing the fixed blade 80 are provided at a top portion of the main body portion 61. A resin-made paper guide 69 is fixed to the outer face of the main body portion 61. The paper guide 69 is formed in a laterally elongated rectangular shape in a front view and has fixing holes 609 and 609 at positions opposing the pair of fixing holes of the main body portion 61, respectively. The bottom face of the paper guide 69 has a tapered shape and has a function of pushing downward the roll sheet 30 that has been carried upward and has run against the bottom face of the paper guide 69 so as to guide the roll sheet 30 back to the correct path. A laterally elongated hole is formed in a central portion in the vertical direction of the paper guide 69, so that when the cutter unit 8 is assembled into the main body case 2, a part of the platen roller 35 may be released into the hole. A guide hole 66 having a circular shape in a front view is formed substantially in a central portion of the main body portion 61. A movement shaft 106 for vertically moving the movable blade 90 is projected from the inner face side of the main body frame 60 through the guide hole 66.

Next, the protective frame 70 will be described. As shown in FIG. 7, the protective frame 70 made of metal includes a main body portion 71 having a substantially rectangular shape in a front view. A cut-out portion 710 is formed by cutting out a rectangular portion from the lower left corner of the main body portion 71. A supporting piece 72 having a laterally elongated rectangular shape in a plan view is extended from a top end of the main body portion 71 toward the main body portion 61 of the main body frame 60. A right locking piece 73 and a left locking piece 74 each having a rectangular shape are extended outward substantially horizontally from a top portion of the right and left ends of the main body portion 71, respectively. The right locking piece 73 is inserted and pressed into the locking concave portion 602 of the right side wall piece 62 of the main body frame 60. The left locking piece 74 is inserted and pressed into the locking concave portion 603 of the left side wall piece 63 of the main body frame 60.

The supporting pieces 75 and 76 are extended from the main body portion 71 toward the inner face side of the protective frame 70, below the right locking piece 73 and the left locking piece 74, respectively. The outer faces of the supporting pieces 75, 76 are in contact with and fixed to the inner faces of the right side wall piece 62 and the left side wall piece 63 of the main body frame 60, respectively. A bottom locking piece 78 is extended downward from the center of the bottom end of the main body portion 71. The bottom locking piece 78 is inserted into the mounting hole 607 of the mounting piece 67 of the main body frame 60. In such a manner, the protective frame 70 is assembled onto the main body frame 60. A supporting piece 77 is bent back and extended at a right angle from a vertical edge of the cut-out portion 710 toward the inner side of the protective frame 70. The supporting piece 77 is in contact with an end of the drive motor 19 so as to support the drive motor 19.

In the protective frame 70, a rib supporting member 79 having an L-shaped section is fixed with a screw 99 to the top face of the supporting piece 72. A plurality of ribs 709 projecting upward are provided at predetermined intervals along the top end of the rib supporting member 79. The top end of the rib supporting member 79 is located between the cutting edge of the fixed blade 80 and the cutting edge of the movable blade 90 at standby positions. Consequently, the roll sheet 30 that has been fed from the thermal head 32 may slide on the plurality of ribs 709 provided on the top end portion of the rib supporting member 79 so as to be guided to a space between the fixed blade 80 and the movable blade 90.

Next, the drive mechanism 105 and the protective film 95 for protecting the drive mechanism 105 will be described. As shown in FIG. 8, the drive mechanism 105 for moving the movable blade 90, which will be described later, is provided inside the protective frame 70. The drive mechanism 105 includes the drive motor 19, and the movement shaft 106. The movement shaft 106 vertically reciprocates the movable blade 90 by means of the drive of the drive motor 19.

A resin-made protective film 95 having an L-shaped section is disposed between the drive mechanism 105 and the movable blade 90. The protective film 95 is formed by bending back substantially horizontally a predetermined width on the top end side of a substantially rectangular film. The top face on the top end side that has been bent back substantially horizontally is in contact with and fixed to the bottom face of the supporting piece 72 of the protective frame 70 with a plurality of screws (not shown). A double-sided tape may be used for fixing the protective film 95 to the protective frame 70. A guide hole 905 having a circular shape in a front view is provided at the center of the protective film 95. The movement shaft 106 of the drive mechanism 105 is projected from the inner side of the main body frame 60 through the guide hole 905. The protective film 95 covers the drive mechanism 105 against the movable blade 90 side, to prevent cutting scraps of the roll sheet 30 and foreign matters from entering the drive mechanism 105, for example.

Next, the fixed blade 80 and the movable blade 90 will be described. As shown in FIG. 7, the fixed blade 80 is fixed at a top portion of the inner face of the main body frame 60 with screws 98. As shown in FIG. 8, the movable blade 90 is supported such that the movable blade 90 may be raised and lowered from below with respect to the fixed blade 80. The movable blade 90 is disposed on the downstream side in the feeding direction of the roll sheet 30, relative to the fixed blade 80. When the movable blade 90 moves upward from below the fixed blade 80, a blade face of the fixed blade 80 and a blade face of the movable blade 90 slide with respect to each other. When the movable blade 90 is located at a standby position, that is, at its lowest position, there is a gap 100 between the leading end of the fixed blade 80 and the leading end of the movable blade 90. The roll sheet 30 is fed through the gap 100.

Figure 9:
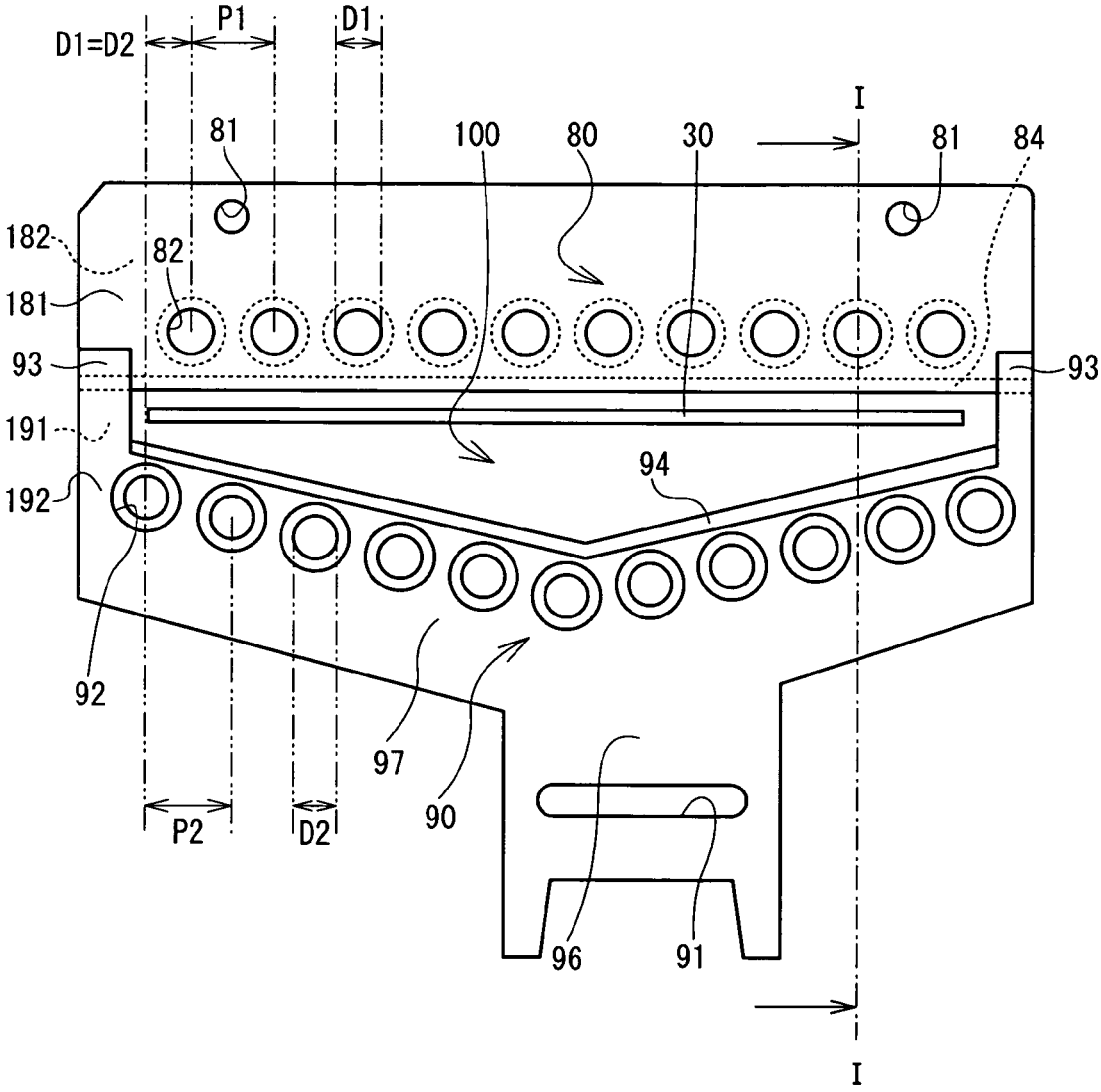
FIG. 9 is a front view a fixed blade and a movable blade that shows a positional relationship thereof during a standby time.
Figure 10:
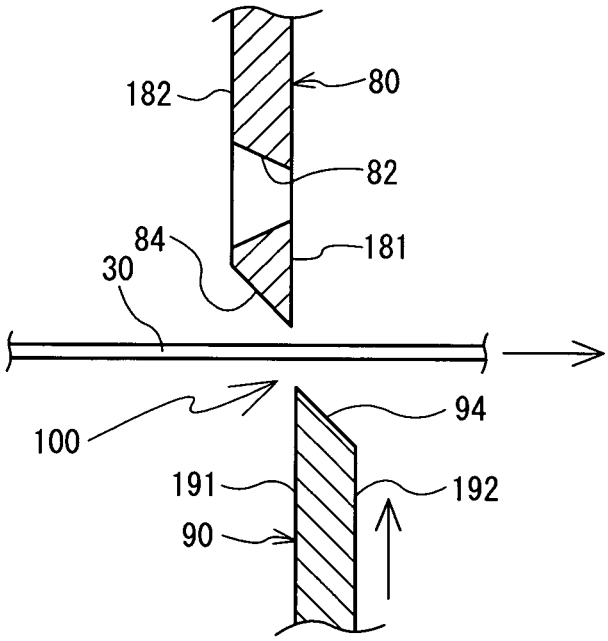
FIG. 10 is a sectional view taken along line I-I shown in FIG. 9, as seen in the direction of the arrow.

The shapes of the fixed blade 80 and the movable blade 90 will be described in detail below with reference to FIG. 9. First, the fixed blade 80 will be described. As shown in FIG. 9, the fixed blade 80 is formed in a form of a plate having a laterally elongated rectangular shape in a front view. The cutting edge of the fixed blade 80 is oriented downward. The cutting edge has a taper face 84. The fixed blade 80 is disposed such that the taper face 84 faces the upstream side in the feeding direction of the roll sheet 30 (toward the far side in FIG. 9), as shown in FIG. 10. A pair of fixing holes 81 are provided at the top portion on both sides in the longitudinal direction (width direction) of the fixed blade 80. The fixed blade 80 may be fixed as follows. First, the fixed blade 80 is aligned with the main body frame 60, more specifically, with the top portion of the inner face of the main body portion 61 (see FIGS. 6 and 7). Then, the screws 98 are tightened into the pair of fixing holes 81, respectively. At this time, the leading end portion (cutting edge) of the fixed blade 80 is positioned on the upper side of the insertion hole 68 of the main body portion 61.

The fixed blade 80 has a plurality of first through holes 82 formed at regular intervals along the width direction of the fixed blade 80. The opening portions of the first through holes 82 each have a circular shape. The first through hole 82 has an inner peripheral face having a tapered shape. The diameter of the first through hole 82 increases from a first sliding face 181 (the face on the downstream side in the feeding direction of the roll sheet 30) toward an opposite face 182. The first sliding face 181 is one of the faces of the fixed blade 80 over which the fixed blade 80 slides with respect to the movable blade 90. The opposite face 182 is the other face of the fixed blade 80 opposite to the first sliding face 181. Consequently, an edge sloped at an acute angle to the first sliding face 181 is formed at the opening portion of the first through hole 82 on the first sliding face 181 side. The opening portion of the first through hole 82 on the first sliding face 181 side will be hereinafter referred to as a first opening.

All the first through holes 82 are formed in an overlapping portion of the fixed blade 80. The overlapping portion of the fixed blade 80 is a portion at which the fixed blade 80 slides with respect to and overlaps with the movable blade 90 during a cutting operation. The overlapping portion of the fixed blade 80 will be hereinafter referred to as a fist overlapping portion. It is not required that an entirety of each of the first through holes 82 be included in the first overlapping portion, but it is only required that each of the first openings on the first sliding face 181 be at least partly included in the first overlapping portion. Further, a center-to-center distance P1 between the first openings of adjacent first through holes 82 in the width direction of the fixed blade 80 is twice a diameter D1 of the first opening of the first through hole 82 ($P1=2\times D1$).

Next, the movable blade 90 will be described. As shown in FIG. 9, the movable blade 90 is formed into a laterally elongated Y shape in a front view. The movable blade 90 includes a cutting portion 97 having a V shape in a front view and a supporting portion 96 having a substantially rectangular shape in a front view. The supporting portion 96 is extended downward from a substantial center of the bottom of the cutting portion 97. The V-shaped cutting edge of the movable blade 90 is oriented upward and has a taper face 94. The movable blade 90 is disposed such that the taper face 94 faces the downstream side in the feeding direction of the roll sheet 30 (toward the near side in FIG. 9), as shown in FIG. 10.

The cutting portion 97 has a plurality of second through holes 92 formed at regular intervals along a longitudinal direction (width direction) of the movable blade 90. The opening portions of the second through holes 92 each have a circular shape. The second through hole 92 has an inner peripheral face having a tapered shape. The diameter of the second through hole 92 increases from a second sliding face 191 (the face on the upstream side in the feeding direction of the roll sheet 30) toward an opposite face 192. The second sliding face 191 is one of the faces of the movable blade 90 over which the movable blade 90 slides with respect to the fixed blade 80. The opposite face 192 is the other face of the movable blade 90 opposite to the second sliding face 191. Consequently, the second through hole 92 has an edge sloped at an acute angle to the second sliding face 191 at the opening portion on the second sliding face 191 side. The opening portion of the second through hole 92 on the second sliding face 191 side will be hereinafter referred to as a second opening.

All the second through holes 92 are formed in an overlapping portion of the movable blade 90. The overlapping portion of the movable blade 90 is a portion at which the movable blade 90 slides with respect to and overlaps with the fixed blade 80 during a cutting operation. The overlapping portion of the movable blade 90 will be hereinafter referred to as a second overlapping portion. It is not required that an entirety of each of the second through holes 92 be included in the second overlapping portion, but it is only required that each of the second openings on the second sliding face 191 be at least partly included in the second overlapping portion. Further, a center-to-center distance P2 between the second openings of adjacent second through holes 92 in the width direction of the movable blade 90 is twice a diameter D2 of the second opening of the second through hole 92 (P2=2×D2). Further, the diameter D2 of the second opening of the second through hole 92 is the same as the diameter D1 of the first opening of the first through hole 82 (D1=D2).

Projecting pieces 93 are projected upward from both sides in the width direction of the cutting portion 97. The projecting pieces 93 are in contact with the front face of the fixed blade 80 even when the movable blade 90 is located at the lowest position. Consequently, the movable blade 90 is stably supported, and the mutual positional relationship between the movable blade 80 and the fixed blade 80 is maintained.

A substantially horizontally long guide hole 91 is provided on the lower side of the supporting portion 96. The movement shaft 106 for vertically moving the movable blade 90 is inserted into the guide hole 91, as shown in FIG. 8. The movement shaft 106 is extended in the thickness direction of the movable blade 90 and is rotatable. When the drive motor 19 is driven, the movement shaft 106 rotates. Then, the movement shaft 106 vertically moves an entirety of the movable blade 90, while moving rightward and leftward inside the guide hole 91 of the movable blade 90.

As shown in FIG. 9, the fixed blade 80 and the movable blade 90 have an equal width (lateral length), and the movable blade 90 slides vertically with respect to the fixed blade 80 with its right and left ends aligned with those of the fixed blade 80. In the present embodiment, in the width direction of the blades, the center position of the leftmost first opening of the first through hole 82 is located to the right side of the center position of the leftmost second opening of the second through hole 92 by a distance equal to the diameters D1, D2 (D1=D2) of the first opening and the second opening. In other words, the first through holes 82 and the second through holes 92 are disposed such that the center-to-center distance in the width direction between the first opening and the second opening that are closest to each other is equal to the diameters D1, D2.

Next, a cutting operation of the cutter unit 8 configured as described above will be described with reference to FIGS. 9 to 14. As shown in FIG. 9, When the cutter unit 8 is standing by, the movable blade 90 is located at its lowest position. During a printing operation, as shown in FIG. 10, the printed roll sheet 30 is fed through the gap 100 of the cutter unit 8 by the rotation of the platen roller 35 (see FIG. 3). Then, when a desired cutting position of the printed roll sheet 30 has been fed to the gap 100, the movable blade 90 is moved upward by the drive mechanism 105, as shown in FIGS. 11 to 14. At this time, the movable blade 90, which has a cutting edge formed into a V shape, and the fixed blade 80, which has a cutting edge formed into a linear shape, gradually come into contact with each other from both sides in the width direction of each blade face toward the center. Thus, the roll sheet 30 is cut from both sides of its width direction toward the center.

Figure 12:
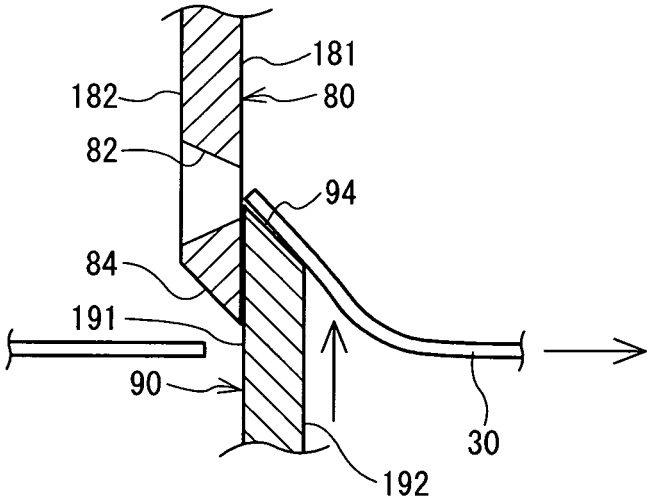
FIG. 12 is a view of a state in which the movable blade shown in FIG. 10 has been raised.
Figure 13:
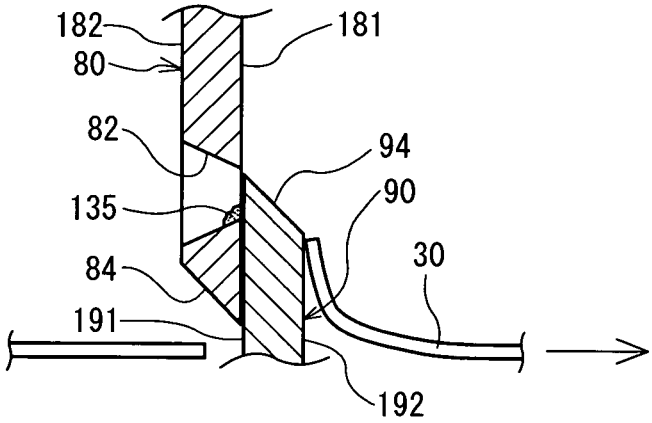
FIG. 13 is a sectional view taken along line II-II shown in FIG. 11, as seen in the direction of the arrow.

When the roll sheet 30 is cut, an adhesive 135 that has come out from the adhesive layer 132 (see FIG. 5) of the cut roll sheet 30 may adhere to the blade faces of the fixed blade 80 and the movable blade 90. As shown in FIGS. 12 and 13, when the fixed blade 80 and the movable blade 90 slide with respect to each other, the adhesive 135 that has adhered to the blade face of the movable blade 90 may come into contact with the acute-angled edge of the first through hole 82 on the first sliding face 181 side of the fixed blade 80. Then, the edge of the first through hole 82 scrapes the adhesive 135 off the blade face of the movable blade 90. The scraped-off adhesive 135 is dropped into the first through hole 82.

Figure 14:
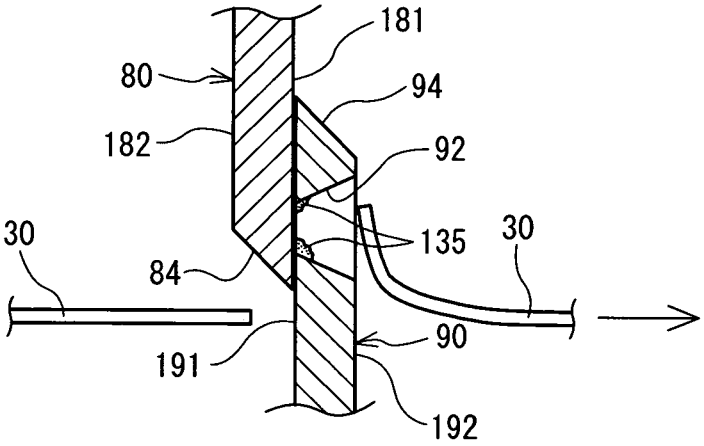
FIG. 14 is a sectional view taken along line III-III shown in FIG. 11, as seen in the direction of the arrow.

Similarly, as shown in FIG. 14, when the fixed blade 80 and the movable blade 90 slide with respect to each other, the adhesive 135 that has adhered to the blade face of the fixed blade 80 may come into contact with the edge of the second through hole 92 on the second sliding face 191 side of the movable blade 90. Then, the adhesive 135 is scraped off by the edge of the second through hole 92, and dropped into the second through hole 92. Thus, the adhesive 135 may not be likely to remain on the blade faces of the fixed blade 80 and the movable blade 90. Therefore, poor cutting of the roll sheet 30 due to the effect of the adhesion of the adhesive 135 may be prevented.

Further, when the fixed blade 80 and the movable blade 90 slide with respect to each other, the adhesive 135 that has adhered to the blade face of the movable blade 90 may once come off the blade face and move on the blade face because of a frictional force. The adhesive 135 may move on the blade face of the movable blade 90 to a position at which the adhesive 135 faces the first opening of the first through hole 82. Then, adhesive 135 is no longer subject to the frictional force, because the adhesive 135 is not in contact with the blade face of the fixed blade 80 any more, and so is dropped into the first through hole 82 (see FIGS. 12 and 13).

Similarly, the adhesive 135 may move on the blade face of the fixed blade 80 to a position at which the adhesive 135 faces the second opening of the second through hole 92. Then, the adhesive 135 is no longer subject to the frictional force, because the adhesive 135 is not in contact with the blade face of the movable blade 90 any more, and so is dropped into the second through hole 92 (see FIG. 14). In such a manner, the adhesive 135 that has come off the blade faces is dropped into the first through hole 82 and the second through hole 92 (hereinafter collectively referred to as "through holes 82 and 92") without adhering to the blade faces again. Therefore, the adhesive 135 may not be likely to remain on the blade faces of the fixed blade 80 and the movable blade 90. Accordingly, poor cutting of the roll sheet 30 due to the effect of the adhesion of the adhesive 135 may be prevented.

Further, the adhesive 135 that has been dropped into the first through hole 82 and the second through hole 92 from the sliding faces 181 and 191 may be discharged from the opposite faces 182 and 192. The diameter of the openings of the through holes 82 and 92 on the opposite faces 182 and 192, through which the adhesive 135 is discharged, is larger than the diameter of the first and second openings on the sliding faces 181 and 191, through which the adhesive 135 is taken in. Therefore, the adhesive 135 that has been dropped into the through holes 82 and 92 may be discharged smoothly. Consequently, the cutter unit 8 may exhibit good usability that may require little maintenance operations, such as the removal of the adhesive 135.

Figure 11:
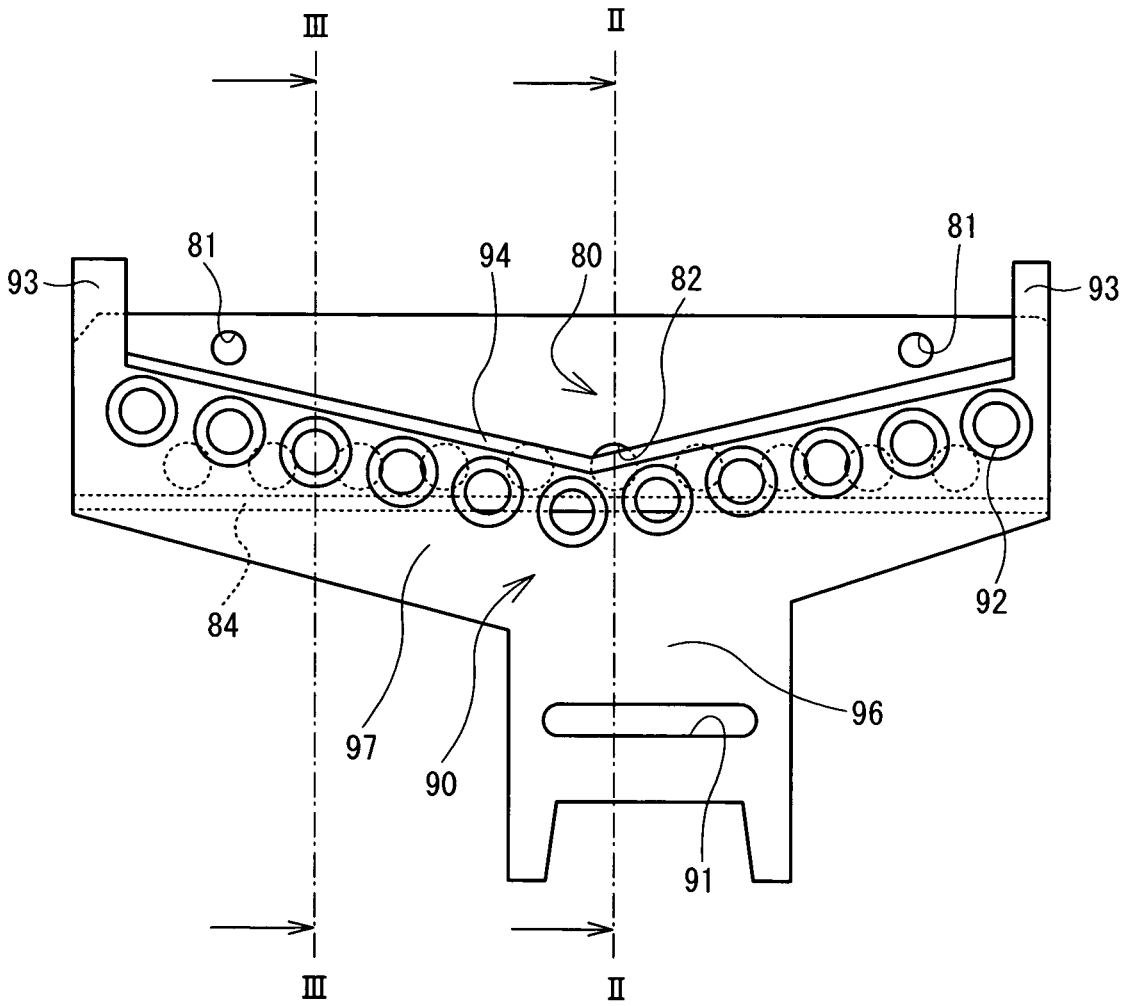
FIG. 11 is a front view of the fixed blade and the movable blade that shows the positional relationship thereof during cutting.

Further, as shown in FIG. 11, in a state where the fixed blade 80 and the movable blade 90 overlap with each other, the positions of the through holes 82 and 92 are different in the width direction of the fixed blade 80 and the movable blade 90. More specifically, the first openings of the first through holes 82 and the second openings of the second through holes 92 may be located at positions at which the first openings and the second openings partly overlap with each other in a direction orthogonal to the movement direction of the movable blade 90 with respect to the fixed blade 80. However, the first openings and the second openings do not completely overlap with each other in the direction orthogonal to the movement direction of the movable blade 90 with respect to the fixed blade 80.

Thus, compared with the case in which the first openings of the first through holes 82 and the second openings of the second through holes 92 completely overlap with each other in the width direction, a contact area during sliding between the edges at the second openings and the blade face of the fixed blade 80, and a contact area during sliding between the edges at the first openings and the blade face of the movable blade 90 may be increased. When the fixed blade 80 and the movable blade 90 slide with respect to each other, the adhesive 135 that has adhered to the blade faces of the fixed blade 80 and the movable blade 90 may come into contact with the edges at the first and second openings of the through holes 92 and 82 and may be dropped into the through holes 92 and 82. In the present embodiment, a larger amount of the adhesive 135 that has adhered to the blade faces may be removed, due to an increase in the contact areas between the blade faces and the edges of the through holes 82 and 92. Consequently, cutting of the roll sheet 30 may not be deteriorated.

Further, in the present embodiment, the first openings of the first through holes 82 on the first sliding face 181 and the second openings of the second through holes 92 on the second sliding face 191 are each formed in a circular shape with an identical diameter. Thus, the adhesive 135 may not stick intensively to a specific portion in the through holes 82 and 92, so that the adhesive 135 that has accumulated in the through holes 82 and 92 may be discharged smoothly from the opposite faces 182 and 192. Thus, the cutter unit 8 may exhibit good usability that may require little maintenance operations, such as the removal of the adhesive 135.

During cutting of the roll sheet 30, an external force is applied to the fixed blade 80 and the movable blade 90. Examples of the external force includes forces applied to the fixed blade 80 and the movable blade 90 when the fixed blade 80 and the movable blade 90 come into contact with each other, when the cutting edges of the fixed blade 80 and the movable blade 90 come into contact with the roll sheet 30, and when the movable blade 90 is raised by the drive of the drive motor 19. When the external force is applied to the fixed blade 80 and the movable blade 90, stress may be generated within the fixed blade 80 and the movable blade 90. In the present embodiment, the stress within the blades may be distributed without concentrating at a specific portion because the through holes 82 and 92 each have a circular shape. Consequently, fatigue at a specific portion may be prevented, thereby improving a durability of the fixed blade 80 and the movable blade 90. Further, strain of the blades may be prevented from occurring at a portion at which stress concentrates, thereby preventing poor cutting of the roll sheet 30.

Further, in the present embodiment, a decrease in the strength at a specific portion may be prevented, because the through holes 82 and 92 are formed in a circular shape. In other words, variations in the strength within the fixed blade 80 and within the movable blade 90 may be suppressed. Accordingly, strain of the fixed blade 80 and the movable blade 90 may be prevented, thereby preventing poor cutting of the roll sheet 30.

Further, in the present embodiment, the first through holes 82 and the second through holes 92 are respectively disposed at center-to-center distances P1, P2 (P1=P2) that are twice the diameters D1, D2 (D1=D2) of the first and second openings of the through holes 82 and 92 in the fixed blade 80 and the movable blade 90 (see FIG. 9). Additionally, the first through holes 82 and the second through holes 92 are disposed such that the center-to-center distance in the width direction of the blades between the first opening and the second opening that are closest to each other is equal to the diameters D1, D2 in a state where the fixed blade 80 and the movable blade 90 overlap with each other.

Consequently, no gap exists in the width direction of the blades between the first opening and the second opening that are closest to each other, so that the adhesive 135 that has adhered to the blade faces of the fixed blade 80 and the movable blade 90 may be dropped into either of the through holes 82 and 92. Consequently, poor cutting of the roll sheet 30 due to the effect of the adhesion of the adhesive 135 may be surely prevented. Further, the first openings of the first through holes 82 and the second openings of the second through holes 92 do not completely overlap with each other at any portion in the width direction of the blade. Thus, it is possible to decrease the ratio of the through holes 82 and 92 formed in the fixed blade 80 and the movable blade 90, thereby maintaining the strength of the fixed blade 80 and the movable blade 90.

Further, the first through holes 82 and the second through holes 92 are provided in plurality. Therefore, the strength of the fixed blade 80 and the movable blade 90 may be less likely to decrease, compared with, for example, a case in which one through hole extends along the cutting edge in the length direction. Further, deflection of the cutting edges may be less likely to occur. Consequently, poor cutting of the roll sheet 30 due to the deflection of the cutting edges may be prevented.

As described above, the tape printing apparatus 1 of the present embodiment includes the cutter unit 8 that cuts the printed roll sheet 30. The cutter unit 8 includes the flat-plate-shaped fixed blade 80 and the Y-shaped movable blade 90 that slidingly moves with respect to the fixed blade 80. The fixed blade 80 has the plurality of first through holes 82 provided in the first overlapping portion at which the fixed blade 80 slides with respect to and overlaps with the movable blade 90. The movable blade 90 has the plurality of second through holes 92 provided in the second overlapping portion at which the movable blade 90 slides with respect to and overlaps with the fixed blade 80. Thus, even when the adhesive 135 of the roll sheet 30 adheres to the blade face of the fixed blade 80, the adhered adhesive 135 may be dropped into the second through holes 92 when the fixed blade 80 and the movable blade 90 slide with respect to each other. Further, the adhesive 135 that has adhered to the blade face of the movable blade 90 may be dropped into the first through holes 82 when the fixed blade 80 and the movable blade 90 slide with respect to each other. Thus, the adhesive 135 that has adhered to the blade faces of the fixed blade 80 and the blade face of the movable blade 90 may be removed. Accordingly, poor cutting of the roll sheet 30 due to the effect of the adhesion of the adhesive 135 may be prevented.

Next, a cutter unit of another embodiment will be described. In the cutter unit of the another embodiment, first through holes 802 and second through holes 902 respectively provided in a fixed blade 800 and a movable blade 900 are different in shapes from the first through holes 82 and the second through holes 92 in the cutter unit 8 of the above-described embodiment. The shapes of the fixed blade 800 and the movable blade 900, which are different in shapes from the fixed blade 80 and the movable blade 90 in the above-described embodiment, will be specifically described below, and portions that are identical to those in the above-described embodiment will not be described.

The arrangement of the fixed blade 800 and the movable blade 900 and supporting method therefor are similar to the arrangement of the fixed blade 80 and the movable blade 90 and the supporting method therefor in the above-described embodiment. Like the fixed blade 80, the fixed blade 800 is fixed at the top portion of the inner face of the main body frame 60 (see FIG. 7). Further, like the movable blade 90, the movable blade 900 is supported such that the movable blade 900 can be raised and lowered from below with respect to the fixed blade 800. The movable blade 900 is disposed on the downstream side in the feeding direction of the roll sheet 30 relative to the fixed blade 800. When the movable blade 900 moves upward from below the fixed blade 800, a blade face of the fixed blade 800 and a blade face of the movable blade 900 slide with respect to each other. When the movable blade 900 is located at the standby position, that is, at its lowest position, a gap 100 exists between the leading end of the fixed blade 800 and the leading end of the movable blade 900. A roll sheet 30 is carried through the gap 100.

Figure 15:
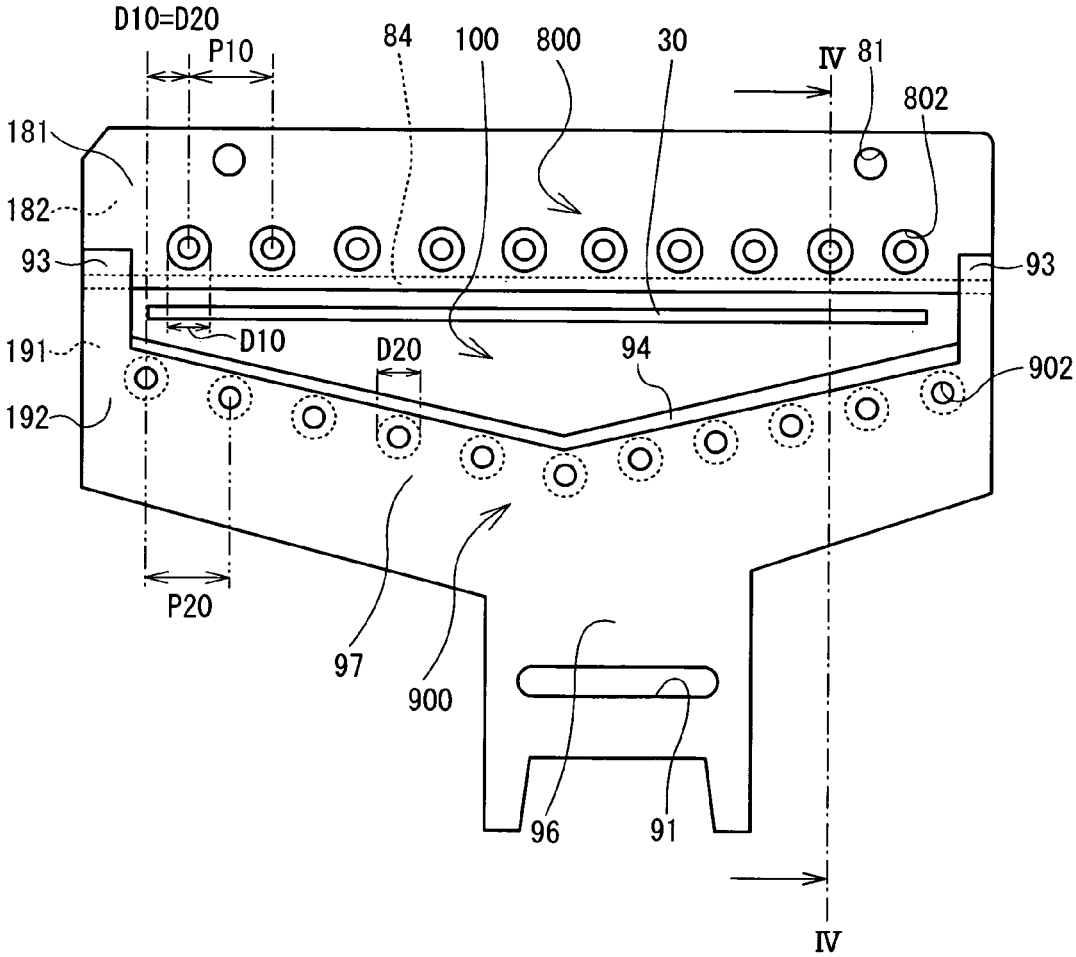
FIG. 15 is a front view of a fixed blade and a movable blade that shows the positional relationship thereof during a standby time in another embodiment.

The shapes of the fixed blade 800 and the movable blade 900 will be described below with reference to FIG. 15. First, the shape of the fixed blade 800 will be described. As shown in FIG. 15, the fixed blade 800 is formed in a form of a plate having a laterally elongated rectangular shape in a front view. A cutting edge of the fixed blade 800 is oriented downward and has a taper face 84 provided thereon. Like the fixed blade 80, the fixed blade 800 is disposed such that the taper face 84 of the cutting edge is oriented toward the upstream side in the feeding direction of the roll sheet 30 (see FIG. 16). Further, a pair of fixing holes 81 are provided at the top portion on both sides in the longitudinal direction (width direction) of the fixed blade 800.

The fixed blade 800 has first through holes 802 formed at regular intervals along the width direction of the fixed blade 800. The opening portions of the first through holes 802 each have a circular shape. The first through hole 802 has an inner peripheral face having a tapered shape. The diameter of first through hole 802 decreases from the first sliding face 181 (the face on the downstream side in the feeding direction of the roll sheet 30) toward the opposite face 182.

All the first through holes 802 are formed in the first overlapping portion of the fixed blade 800. It is not required that an entirety of each of the first through holes 802 be included in the first overlapping portion, but it is only required that each of the first openings of the first through holes 802 on the first sliding face 181 be at least partly included in the first overlapping portion. Further, a center-to-center distance P10 between the first openings of adjacent first through holes 802 in the width direction of the fixed blade 800 is twice a diameter D10 of the first opening (P10=2×D10).

Next, the movable blade 900 will be described. As shown in FIG. 15, the movable blade 900 is formed in a Y shape in a front view. The movable blade 900 includes a cutting portion 97 having a V shape in a front view and a supporting portion 96 having a substantially rectangular shape in a front view and extending downward from a substantial center of the bottom of the cutting portion 97. The V-shaped cutting edge of the movable blade 900 is oriented upward and has a taper face 94 formed thereon. The movable blade 900 is disposed such that the taper face 94 of the cutting edge is oriented toward the downstream side in the feeding direction of the roll sheet 30 (see FIG. 16). Since the configuration of the supporting portion 96 is identical to that in the above-described embodiment, only the configuration of the cutting portion 97 will be described below.

The cutting portion 97 has second through holes 902 formed at regular intervals along the longitudinal direction (width direction) of the movable blade 900. The opening portions of the second through holes 902 each have a circular shape. The second through hole 902 has an inner peripheral face having a tapered shape. The diameter of the second through hole 902 decreases from the second sliding face 191 toward the opposite face 192.

All the second through holes 902 are formed in the second overlapping portion of the movable blade 900. It is not required that an entirety of each of the second through holes 902 be included in the second overlapping portion, but it is only required that each of the second openings of the second through holes 902 on the second sliding face 191 be at least partly included in the second overlapping portion. Further, a center-to-center distance P20 between the second openings of adjacent second through holes 902 in the width direction of the movable blade 900 is twice a diameter D20 of the second opening (P20=2×D20). Further, the diameter D20 of the second opening of the second through hole 902 is the same as the diameter D10 of the first opening of the first through hole 802 (D10=D20).

Projecting pieces 93 are projected upward from both sides in the width direction of the cutting portion 97. The projecting pieces 93 are in contact with the front face of the fixed blade 800 even when the movable blade 900 is located at the lowest position. Consequently, the movable blade 900 is stably supported, and its mutual positional relationship with the fixed blade 800 is maintained.

As shown in FIG. 15, the fixed blade 800 and the movable blade 900 have an equal width (lateral length), and the movable blade 900 overlaps with the fixed blade 800, with its right and left ends aligned with those of the fixed blade 800, and slides vertically with respect to the fixed blade 800. In the present embodiment, the center position of the leftmost first opening of first through hole 802 is located to the right side of the center position of the leftmost second opening of the second through hole 902 by a distance equal to the diameters D10, D20 (D10=D20) of the first opening and the second opening. In other words, the first through holes 802 and the second through holes 902 are disposed such that the center-to-center distance in the width direction between the first opening and the second opening that are closest to each other is equal to the diameters D10, D20.

Figure 16:
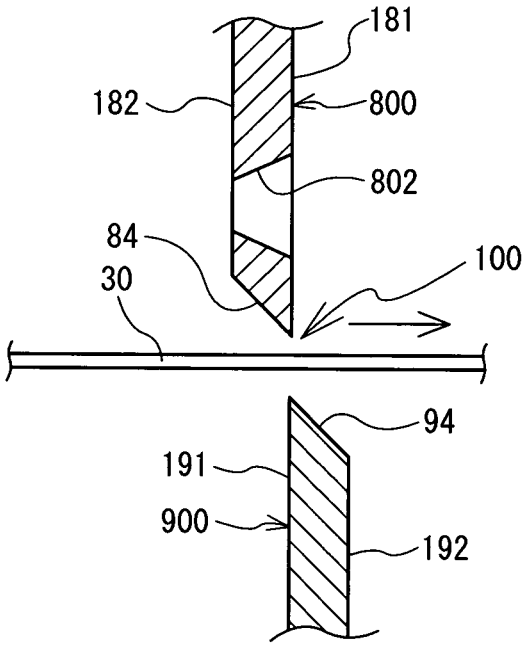
FIG. 16 is a sectional view taken along line IV-IV shown in FIG. 15, as seen in the direction of the arrow.
Figure 17:
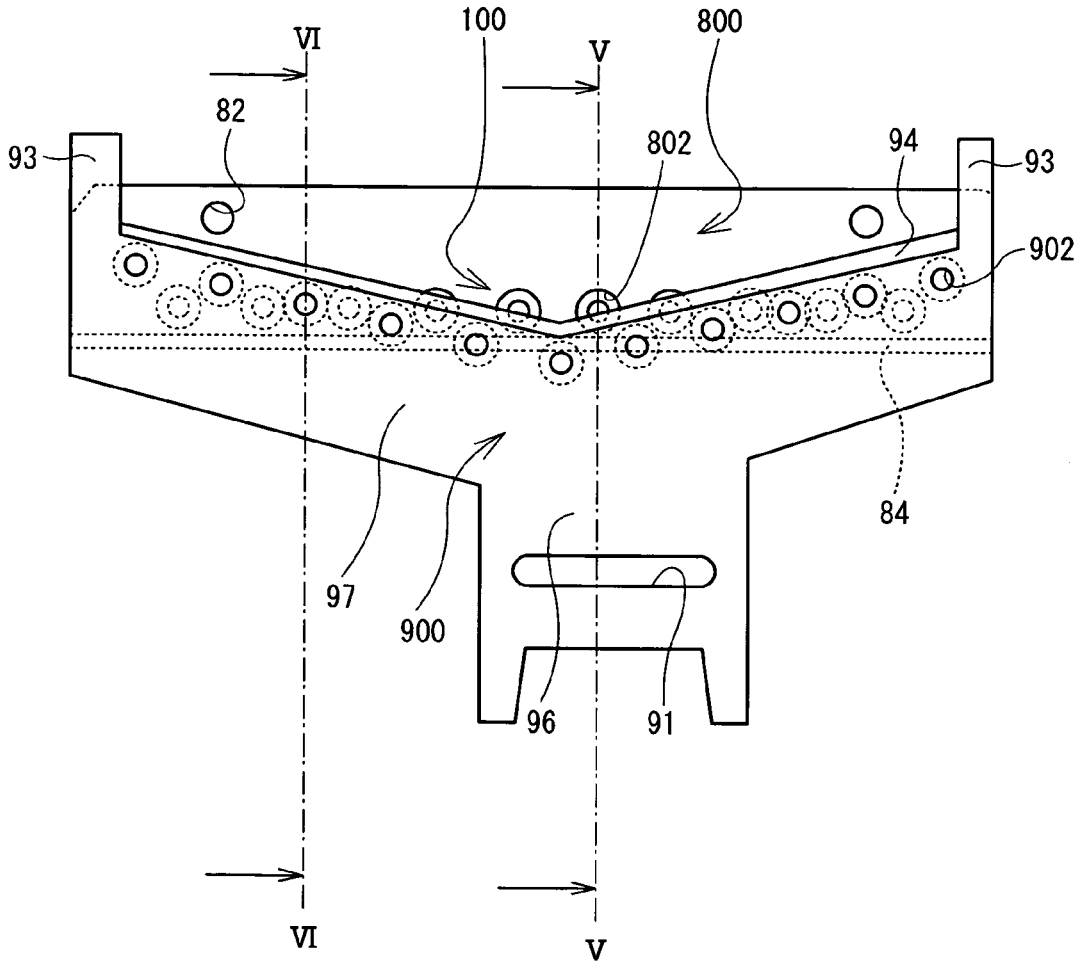
FIG. 17 is a front view of the fixed blade and the movable blade that shows a positional relationship thereof during cutting in the another embodiment.
Figure 18:
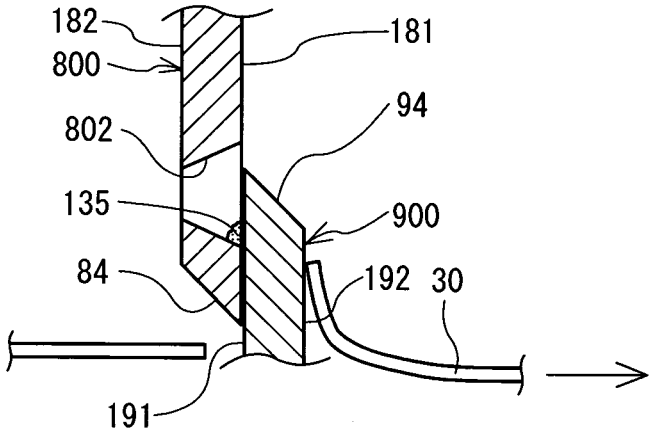
FIG. 18 is a sectional view taken along line V-V shown in FIG. 17, as seen in the direction of the arrow.
Figure 19:
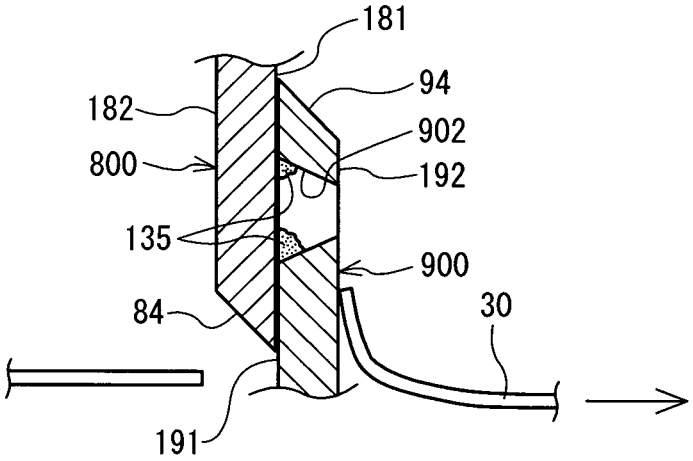
FIG. 19 is a sectional view taken along line VI-VI shown in FIG. 17, as seen in the direction of the arrow.

Next, a cutting operation of the cutter unit which includes the fixed blade 800 and the movable blade 900 will be described with reference to FIGS. 15 to 19. As shown in FIG. 15, when the cutter unit is standing by, the movable blade 900 is located at its lowest position. During a printing operation, as shown in FIG. 16, the printed roll sheet 30 is fed through the gap 100 of the cutter unit by the rotation of a platen roller 35 (see FIG. 3). Then, when a desired cutting position of the printed roll sheet 30 has been fed to the gap 100, the movable blade 900 is moved upward by the drive mechanism 105, as shown in FIGS. 17 to 19. At this time, the movable blade 900 having the V-shaped cutting edge and the fixed blade 800 having the linear cutting edge gradually come into contact with each other from both sides in the width direction of each blade face toward the center. Thus, the roll sheet 30 is cut from both sides of its width direction toward the center.

When the roll sheet 30 is cut, an adhesive 135 that has come out from the adhesive layer 132 (see FIG. 5) of the cut roll sheet 30 may adhere to the blade faces of the fixed blade 800 and the movable blade 900. As shown in FIG. 18, when the fixed blade 800 and the movable blade 900 slide with respect to each other, the adhesive 135 that has adhered to the blade face of the movable blade 900 may come into contact with the inner peripheral face of the first through hole 802. Then, the inner peripheral face of the first through hole 802 pushes the adhesive 135 that has adhered to the blade face of the movable blade 900, and the pushed adhesive 135 is dropped into the first through hole 802.

Further, as shown in FIG. 19, when the fixed blade 800 and the movable blade 900 slide with respect to each other, the adhesive 135 that has adhered to the blade face of the fixed blade 800 may come into contact with the inner peripheral face of the second through hole 902. Then, the inner peripheral face of the second through hole 902 pushes the adhesive 135 that has adhered to the blade face of the fixed blade 800, and the pushed adhesive 135 is dropped into the second through hole 902.

Further, when the fixed blade 800 and the movable blade 900 slide with respect to each other, the adhesive 135 that has adhered to the blade face of the movable blade 900 may once come off the blade face of the movable blade 900 and move on the blade face because of a frictional force generated by its contact with the blade face of the fixed blade 800. The adhesive 135 may move on the blade face of the movable blade 900 to a position at which the adhesive 135 faces the first opening of the first through hole 802. Then, the adhesive 135 is no longer subject to the frictional force, because the adhesive 135 is not in contact with the blade face of the fixed blade 800 any more, and is dropped into the first through hole 802 (see FIG. 18).

Further, when the fixed blade 800 and the movable blade 900 slide with respect to each other, the adhesive 135 that has adhered to the blade face of the fixed blade 800 may once come off the blade face of the fixed blade 800 and move on the blade face because of a frictional force generated by its contact with the blade face of the movable blade 900. The adhesive 135 may move on the blade face of the fixed blade 800 to a position at which the adhesive 135 faces the second opening of the second through hole 902. Then, the adhesive 135 is no longer subject to the frictional force, because the adhesive 135 is not in contact with the blade face of the movable blade 900 any more, and is dropped into the second through hole 902 (see FIG. 19).

In such a manner, the adhesive 135 may not be likely to remain on the blade faces of the fixed blade 800 and the movable blade 900. Accordingly, poor cutting of the roll sheet 30 due to the effect of the adhesion of the adhesive 135 may be prevented.

As described above, according to the cutter unit of the another embodiment, like the cutter unit 8 of the above-described embodiment, the adhesive 135 that has adhered to the blade faces of the fixed blade 800 and the blade faces of the movable blade 900 may be removed. Accordingly, poor cutting of the roll sheet 30 due to the effect of the adhesion of the adhesive 135 may be prevented.

Further, the first through holes 802 and the second through holes 902 in the another embodiment (hereinafter collectively referred to as "through holes 802 and 902") each have a tapered inner peripheral face, and the diameters of the through holes 802 and 902 each decrease from the sliding faces 181 and 191 toward the opposite faces 182 and 192. Consequently, an area of the first and second openings of the through holes 802 and 902 on the sliding faces 181 and 191 may be made larger than an area of the opening portion on the opposite faces 182 and 192. Consequently, a larger amount of the adhesive 135 may be dropped into the through holes 802 and 902. Further, the ratio of the through holes 802 and 902 to the volume of the fixed blade 800 and the movable blade 900 may be decreased because the area of the opening portions of the through holes 802 and 902 on the opposite faces 182 and 192 is decreased while the area of the first and second openings of the through holes 802 and 902 on the sliding faces 181 and 191 is kept large. Consequently, the strength of the fixed blade 800 and the movable blade 900 may be maintained.

The cutting mechanism for a printing apparatus and the printing apparatus including the cutting mechanism of the present disclosure are not limited to the above-described exemplary embodiments. The exemplary embodiments may be modified in various ways within a scope of the present disclosure. For example, in the above-described embodiments, the through holes 82, 92, 802, and 902 each have a tapered inner peripheral face. The through holes, however, need not have a tapered inner peripheral face and may have any shape. For example, the through holes may each have a cylindrical shape. In such a case, the through holes may be formed more simply.

Further, in the above-described exemplary embodiments, the first through holes 82 or 802 and the second through holes 92 or 902 are disposed to have a center-to-center distance that is twice the diameter of the first openings and the second openings in the fixed blades 80, 800 and the movable blades 90, 900, respectively. The diameter of the through holes and the center-to-center distance, however, may have any relationship other than the above example.

Further, in the above-described exemplary embodiments, the through holes provided in the fixed blades 80 or 800 and the movable blades 90 or 900 have an identical shape, an identical volume, and an identical opening area, respectively. The through holes, however, need not be identical. For example, the opening area and the volume of the through holes formed in the central portion in the width direction of the blades may be made larger than those of the through holes formed in other portions, because the adhesive 135 is most likely to move to the central portion in the width direction of the blades. Consequently, poor cutting of the roll sheet 30 due to the effect of the adhesion of the adhesive 135 may be prevented more surely.

Further, while in the above-described exemplary embodiments, the first through holes 82 or 802 and the second through holes 92 or 902 are disposed such that no gap exists in the width direction of the blades between the first opening and the second opening that are closest to each other, the arrangement of the through holes is not limited thereto. For example, a plurality of through holes may be formed only in the central portion in the width direction of the blades because the adhesive 135 is most likely to move to the central portion in the width direction of the blades, as described above.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cutting mechanism for a printing apparatus that cuts a printing medium, the cutting mechanism comprising:

a fixed blade having a plurality of first through holes and a cutting edge which extends in a width direction of the fixed blade; and a movable blade having a plurality of second through holes and slidingly movable with respect to the fixed blade, wherein:

each of a plurality of first openings is at least partly included in a first overlapping portion, the first openings being openings of the first through holes on a first sliding face, the first sliding face being one face of the fixed blade over which the fixed blade slides with respect to the movable blade, and the first overlapping portion being a portion of the fixed blade at which the fixed blade slides with respect to and overlaps with the movable blade;

each of a plurality of second openings is at least partly included in a second overlapping portion, the second openings being openings of the second through holes on a second sliding face, the second sliding face being one face of the movable blade over which the movable blade slides with respect to the fixed blade, and the second overlapping portion being a portion of the movable blade at which the movable blade slides with respect to and overlaps with the fixed blade;

the first openings and the second openings being located at positions such that the first openings and the second openings do not overlap completely with each other in said width direction, the width direction being the direction in which the cutting edge extends wherein no gap exists in the width direction between the first opening and the second opening that are closest to each other when the fixed blade and the movable blade overlap with each other.

2. The cutting mechanism according to claim 1, wherein:

the first openings and the second openings each have a circular shape of an identical diameter;

the first through holes are disposed in the fixed blade such that a distance between centers of adjacent first openings along the width direction is twice the diameter;

the second through holes are disposed in the movable blade such that a distance between centers of adjacent second openings along the width direction is twice the diameter; and a distance in the width direction between centers of the first opening and the second opening that are closest to each other in a state where the fixed blade and the movable blade overlap with each other is equal to the diameter.

3. The cutting mechanism according to claim 1, wherein:

the first through holes each have an inner peripheral face having a tapered shape, and a diameter that increases from the first sliding face toward the other face of the fixed blade opposite to the first sliding face; and the second through holes each have an inner peripheral face having a tapered shape, and a diameter that increases from the second sliding face toward the other face of the movable blade opposite to the second sliding face.

4. The cutting mechanism according to claim 1, wherein:

the first through holes each have an inner peripheral face having a tapered shape, and a diameter that decreases from the first sliding face toward the other face of the fixed blade opposite to the first sliding face; and the second through holes each have an inner peripheral face having a tapered shape, and a diameter that decreases from the second sliding face toward the other face of the movable blade opposite to the second sliding face.

5. The cutting mechanism according to claim 1, wherein:

the fixed blade extends throughout an entire width of the printing medium on one face side of the printing medium and has a linear cutting edge; and the movable blade extends throughout an entire width of the printing medium on the other face side of the printing medium and has a V-shaped cutting edge.

6. A printing apparatus, comprising:

a cutting mechanism that cuts a printing medium and includes:

a fixed blade having a cutting edge which extends in a width direction of the fixed blade and plurality of first through holes; and a movable blade having a plurality of second through holes and slidingly movable with respect to the fixed blade, wherein:

each of a plurality of first openings is at least partly included in a first overlapping portion, the first openings being openings of the first through holes on a first sliding face, the first sliding face being one face of the fixed blade over which the fixed blade slides with respect to the movable blade, and the first overlapping portion being a portion of the fixed blade at which the fixed blade slides with respect to and overlaps with the movable blade;

each of a plurality of second openings is at least partly included in a second overlapping portion, the second openings being openings of the second through holes on a second sliding face, the second sliding face being one face of the movable blade over which the movable blade slides with respect to the fixed blade, and the second overlapping portion being a portion of the movable blade at which the movable blade slides with respect to and overlaps with the fixed blade; and the first openings and the second openings being located at positions such that the first openings and the second openings do not overlap completely with each other in said width direction, the width direction being the direction in which the cutting edge extends wherein no gap exists in the width direction between the first opening and the second opening that are closest to each other when the fixed blade and the movable blade overlap with each other.

7. The printing apparatus according to claim 6, wherein:

the first openings and the second openings each have a circular shape of an identical diameter;

the first through holes are disposed in the fixed blade such that a distance between centers of adjacent first openings along the width direction is twice the diameter;

the second through holes are disposed in the movable blade such that a distance between centers of adjacent second openings along the width direction is twice the diameter; and a distance in the width direction between centers of the first opening and the second opening that are closest to each other in a state where the fixed blade and the movable blade overlap with each other is equal to the diameter.

8. The printing apparatus according to claim 6, wherein:

the first through holes each have an inner peripheral face having a tapered shape, and a diameter that increases from the first sliding face toward the other face of the fixed blade opposite to the first sliding face; and the second through holes each have an inner peripheral face having a tapered shape, and a diameter that increases from the second sliding face toward the other face of the movable blade opposite to the second sliding face.

9. The printing apparatus according to claim 6, wherein:

the first through holes each have an inner peripheral face having a tapered shape, and a diameter that decreases from the first sliding face toward the other face of the fixed blade opposite to the first sliding face; and the second through holes each have an inner peripheral face having a tapered shape, and a diameter that decreases from the second sliding face toward the other face of the movable blade opposite to the second sliding face.

10. The printing apparatus according to claim 6, wherein:

the fixed blade extends throughout an entire width of the printing medium on one face side of the printing medium and has a linear cutting edge; and the movable blade extends throughout an entire width of the printing medium on the other face side of the printing medium and has a V-shaped cutting edge.

* * * * *